US006321499B1

(12) United States Patent
Chuang

(10) Patent No.: US 6,321,499 B1
(45) Date of Patent: Nov. 27, 2001

(54) WOOD FLOOR ASSEMBLY

(76) Inventor: Fu-Min Chuang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/285,090

(22) Filed: Apr. 2, 1999

(51) Int. Cl.[7] ..... E04B 3/54

(52) U.S. Cl. ..... 52/480; 52/664; 52/668; 52/263

(58) Field of Search ..... 52/220.2, 126.1, 52/262, 480, 668, 630, 263

(56) References Cited

U.S. PATENT DOCUMENTS

| | | | | |
|---|---|---|---|---|
| 2,231,474 | * | 2/1941 | Lachman | 52/668 |
| 4,443,989 | * | 4/1984 | Silvey | 52/480 |
| 4,905,437 | * | 3/1990 | Heather | 52/480 |
| 4,928,471 | * | 5/1990 | Bartley | 52/668 |
| 5,797,236 | * | 8/1998 | Posey | 52/668 |

* cited by examiner

*Primary Examiner*—Beth A. Stephan

(57) ABSTRACT

An assembly type wood floor comprising a high frame and a floor. The high floor is a net-like lattice frame formed by a plurality of upper plates, a plurality of lower plates and a plurality of flat plates. At first, the ⊓ shape grooves of the upper plates is engaged with the U shape grooves of the lower plates, and the lower extended rod on the two sides of the bottom of the ⊓ shape groove may be inserted into the positioning holes on the two sides of the nut of the upper plate. The upper extending rods on the two sides of the top of the U shape grooves are inserted into the positioning holes on the two sides of the nut of the upper plate. Next, the groove on the lower surface of the flat plate is engaged to the engaging plate of the upper plate and the pillar on the center of the engaging groove is inserted into the positioning hole on the middle section of the engaging plate. The floor is formed by a plurality of plate pieces, a plurality of connecting elements and a plurality of edge elements, the lower sections of wood plate pieces are circularly installed with inclined surfaces and ⊏ shape grooves, on the lower surface of the plate near the periphery is installed with ⊓ shape grooves, the connecting element is an integral block having an approximate 山 shape. The edge element thereof is formed by integrating a T shape hard plate and a soft plate.

1 Claim, 7 Drawing Sheets

WOOD FLOOR ASSEMBLY

The present invention relates to an assembly type wood floor assembly, and especially to a wood floor which can be easily attached and detached.

When assembling prior art high frames of wood floor, it increases costs. Accordingly, there is an eager desire to have a DIM (DO IT MYSELF) wood floor which can be easily assembled.

Therefore, the object of the present invention is to provide an assembly type wood floor comprising a high frame and a floor. The high floor is a net-like lattice frame formed by a plurality of upper plates, a plurality of lower plates and a plurality of flat plates.

The present invention will be better understood and its numerous objects and advantages will become apparent to those skilled in the art by referencing the following drawings:

DETAILED DESCRIPTION OF THE PREFERRED EMBODIMENT

Figure 1:
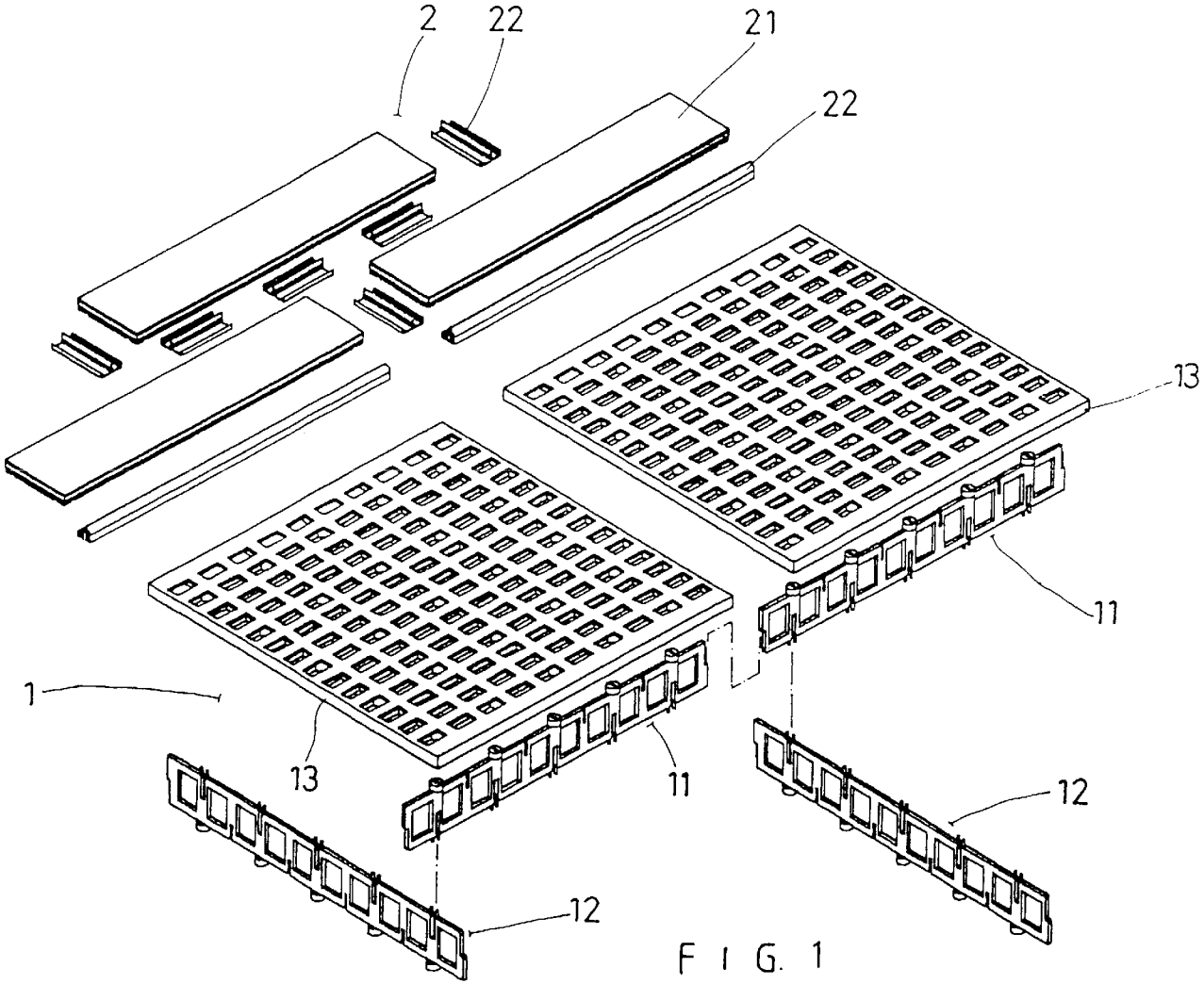
FIG. 1 is an exploded perspective view of the present invention.
Figure 2:
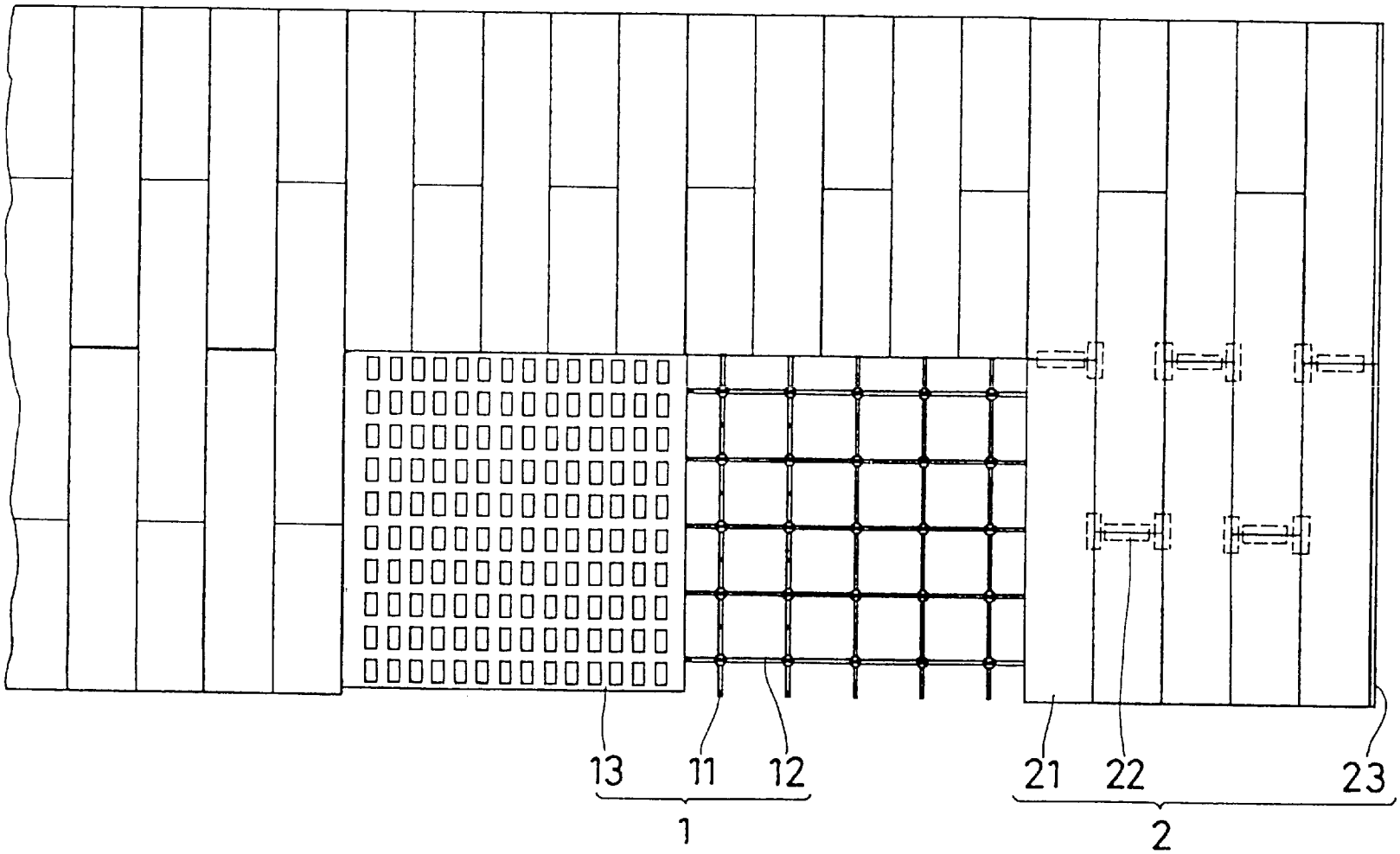
FIG. 2 is an upper view of the present invention.

With reference to FIGS. 1 and 2, the assembly type wood floor of the present invention consists of a high frame (1) and a floor (2).

Figure 3:
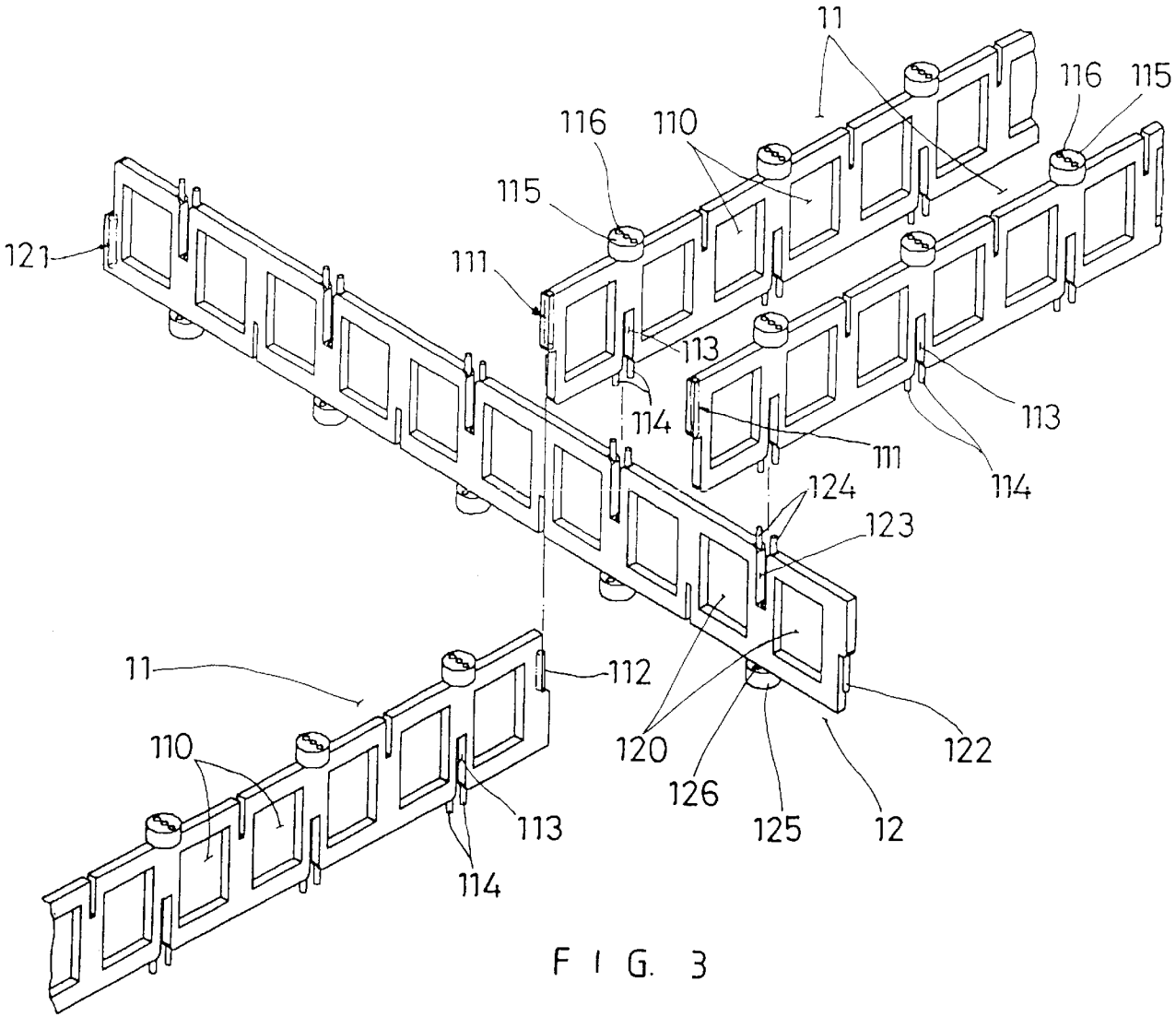
FIG. 3 is an exploded view illustrating the high frame of the present invention.
Figure 4:
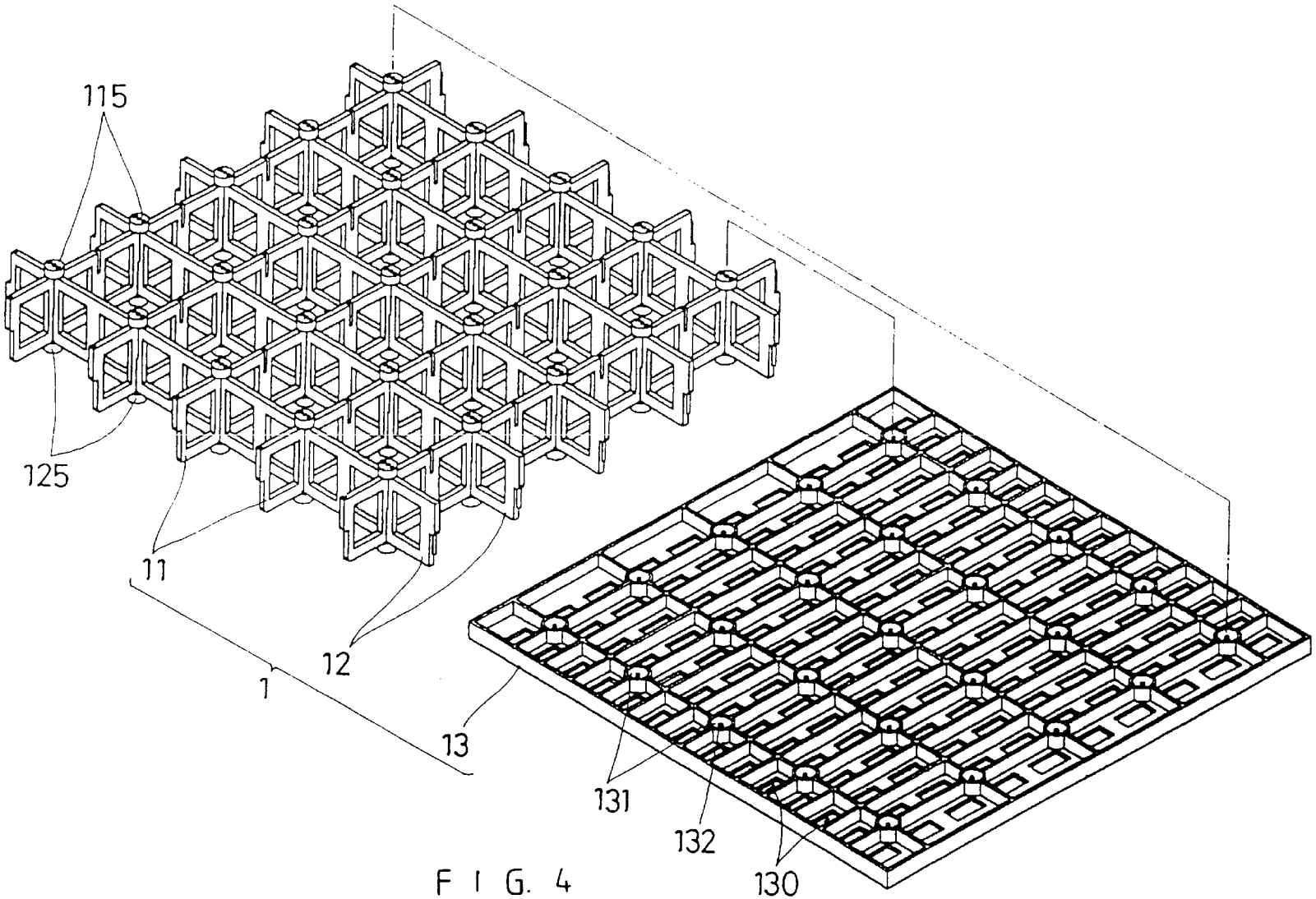
FIG. 4 is an assembled schematic view showing the high frame of the present invention.

The high floor (1) is a net-like lattice frame formed by a plurality of upper plates (11), a plurality of lower plates (12) and a plurality of flat plates (13). The upper plate (11) (with referring to FIG. 3) is a rectangular plate with a plurality of through holes (110), and two opposite sides of which are installed with a rod through groove (111) and a convex rod (112). The lower section of the upper plate (11) is installed with a plurality of inverted U-shape grooves (113) with equal spacing, Two sides at the lower end of the inverted U-shape grooves (113) are formed with respective lower protruding rods (114). A plurality of engaging plates (115) are formed on the upper surface of the upper plate (11) at a position with respect to the ㄇ shape groove (113). Three linearly arranged positioning holes (116) are formed on the center of the engaging plate (115). The lower plate (12) is a rectangular plate with a plurality of through holes (120) and the lower plate (12) can be connected to the upper plate (11) by a cruciform connection way. Two opposite sides of the lower plate (12) are installed with a rod through groove (121) and a convex rod (122). The upper section of the lower plate (12) has a plurality of U-shaped grooves (123) spaced with an equal space. Upper extending rods (124) are formed on the two sides at the upper end of the U shape grooves (123). A plurality of supporting blocks (125) are installed on the lower surface of the lower plate (12) with respect to the U shaped grooves (123). By the supporting block (125), the lower surface of the lower plate (12) will not contact with the ground. Three linearly arranged positioning holes (126) are installed on the central portion of the supporting block (125). Each of flat plate (130) is a square shape having a plurality of through holes (13) and may be positioned so as to be parallel to the ground. A plurality of concave engaging grooves (131) on the bottom thereof with respect to the gap of the engaging plate (115) of the upper plate (11). Each of the engaging groove (131) is preset with a pillar (132) on the center thereof. When the flat plate (13) makes the upper plate (11) downwards, the pillar (132) will pass through the middle positioning hole (116) of each engaging plate (115).

Figure 5:
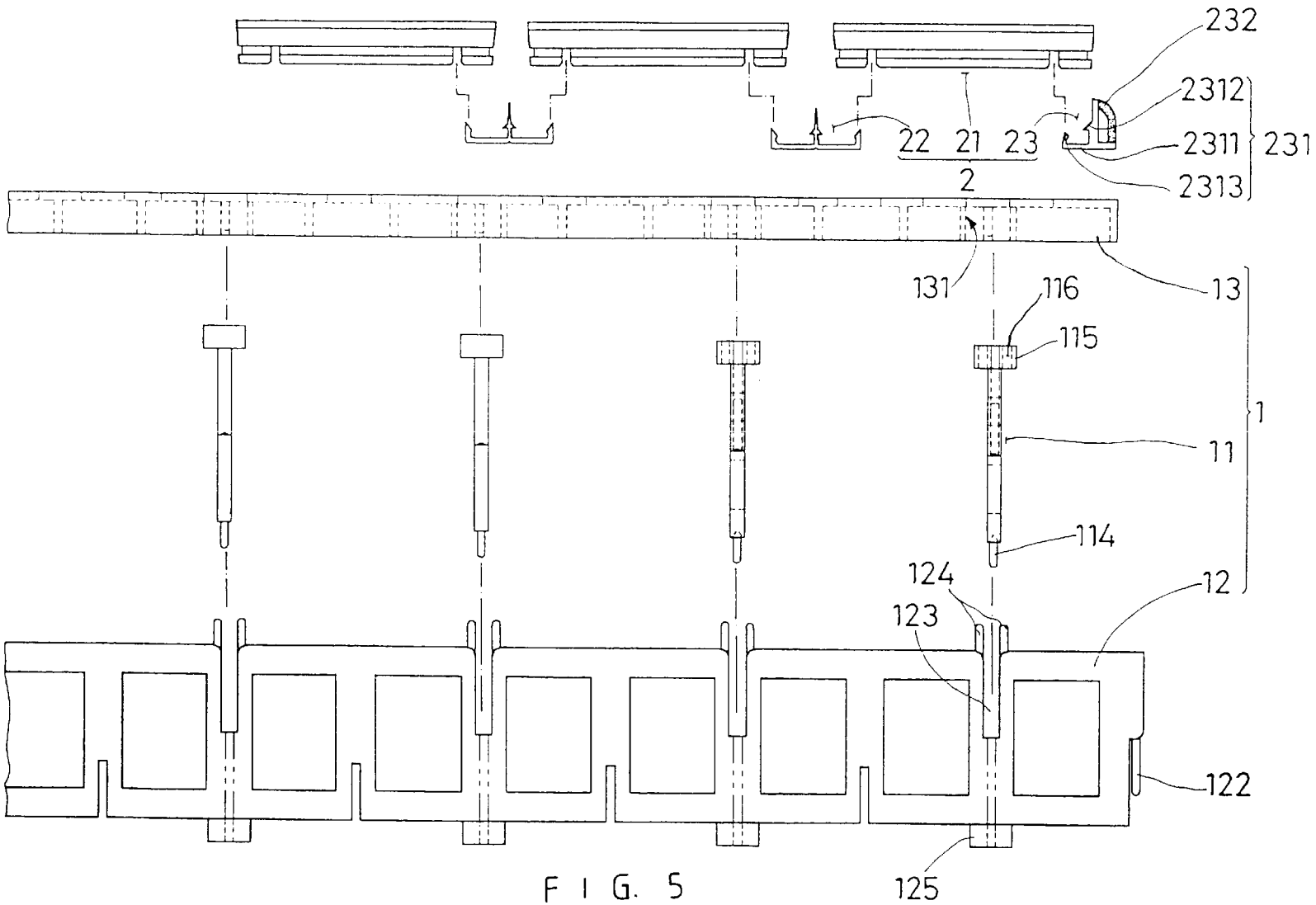
FIG. 5 is a plan exploded view showing the components of the present invention.
Figure 6:
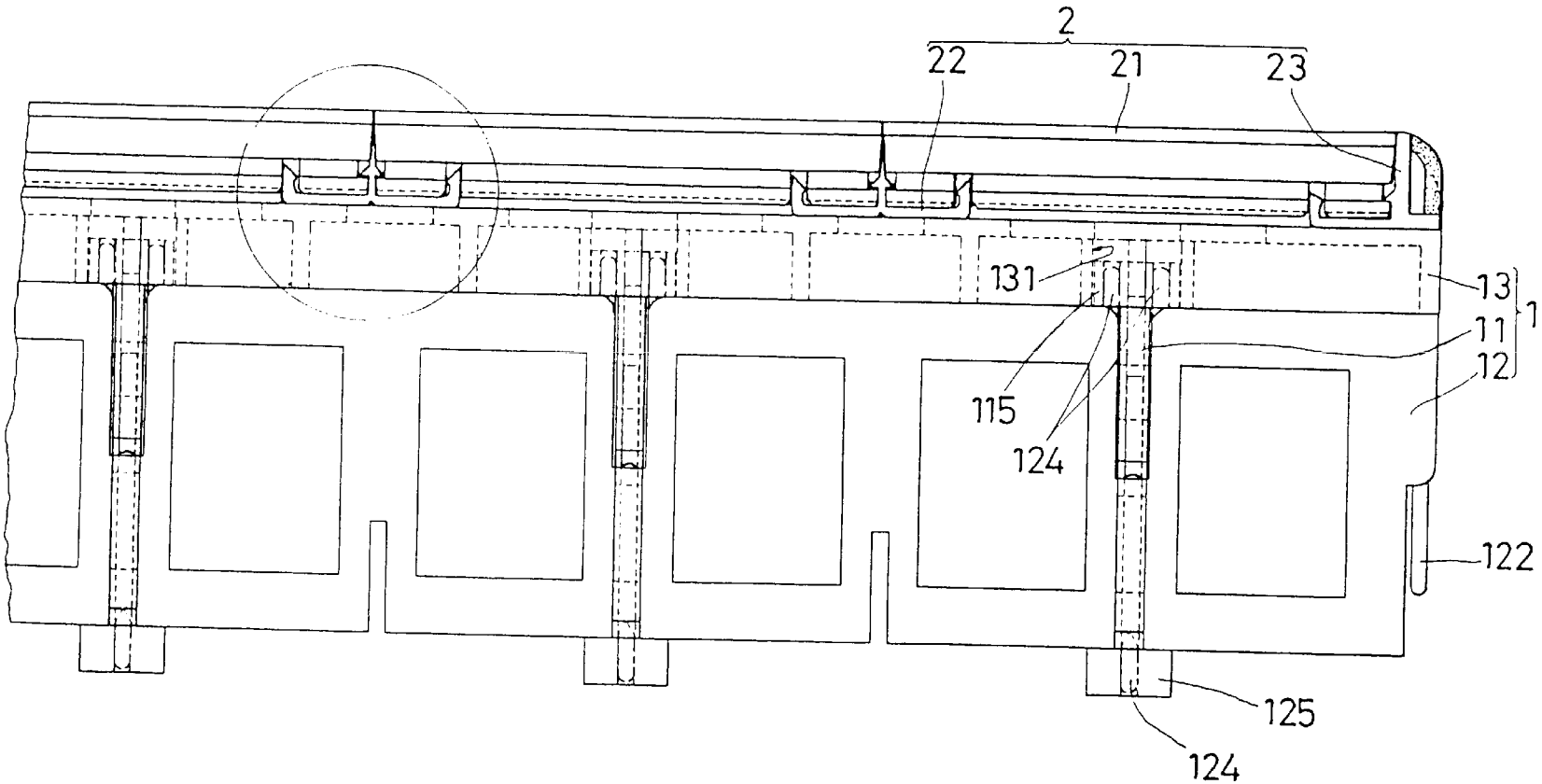
FIG. 6 shows the assembled relation of the present invention.
Figure 7:
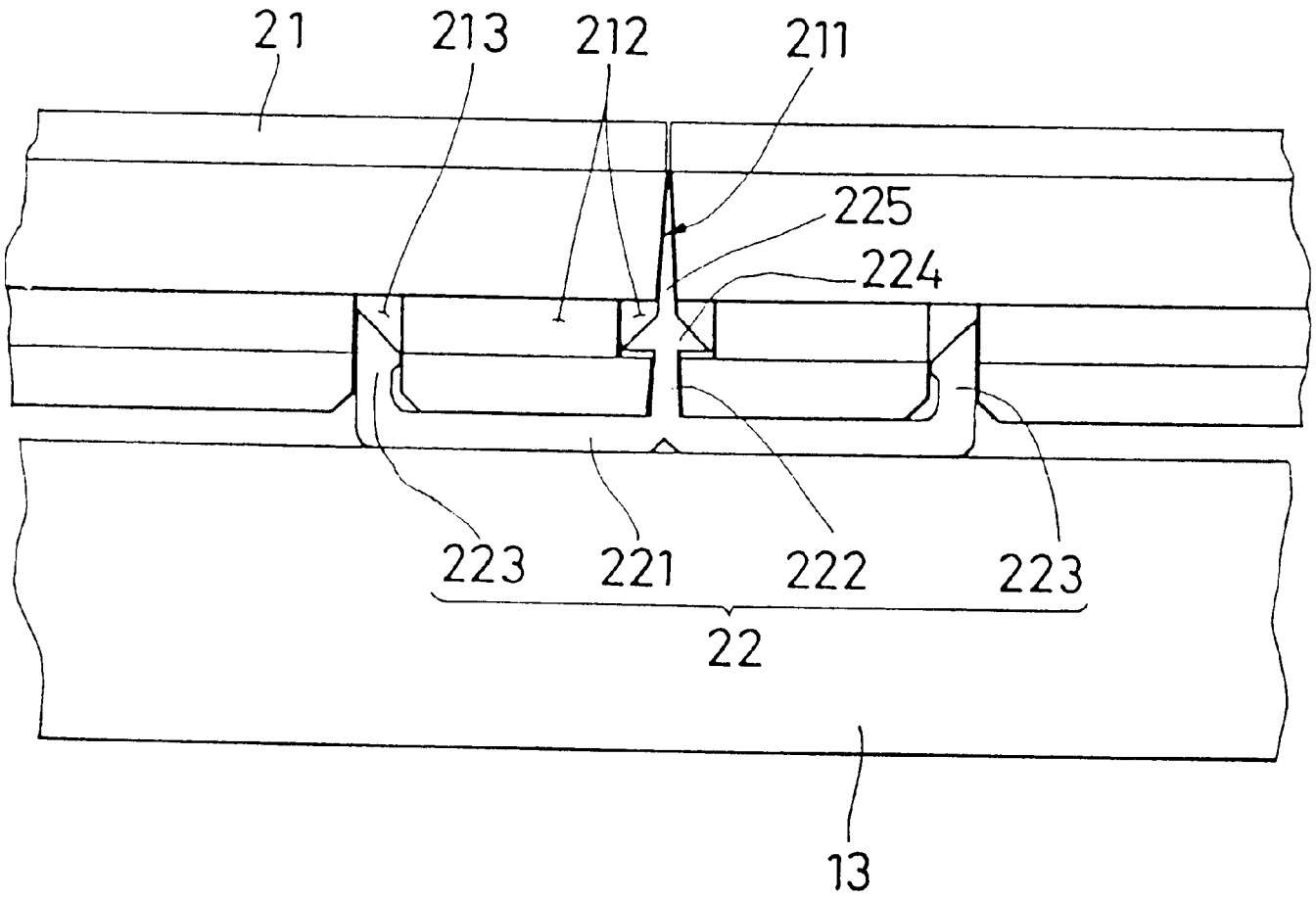
FIG. 7 shows the detail of the floor of the present invention.

Referring to FIGS. 5, 6 and 7, the floor (2) is formed by a plurality of plates (21), a plurality of connecting elements (22) and a plurality of edge element (23). The lower section of the floor being a wood plate is installed with inclined surfaces (211) and ㄷ shape grooves (212). A plurality of shape grooves (213) are formed on a lower surface of the plate (21). The connecting element (22) is an integral block having an approximate 凵 shape, which is formed by a transversal plate (221), a middle plate (222) and two lateral plates (223) having a hook shape. A triangular block (224) is preset on the middle of the middle plate (222), and the upper section of the middle plate (222) has a tapered tip (225) with respect to the inclined surface (211) on the periphery of the plate (21). The edge element (23) is formed by integrating a T shape hard plate (231) and a soft plate (232). The T shape hard plate (231) is formed by a transversal section (2311), a hook (2312) and a groove section (2313). The angle formed by the transversal section (2311) and a groove section (2313) is less than 90 degrees.

In assembling the present invention (referring to FIGS. 1~5), at first, the ㄇ shape grooves (113) of the upper plates (11) are engaged with the U shape grooves (123) of the lower plates (12), and the lower extended rod (114) on the two sides of the bottom of the ㄇ shape groove (113) may be inserted into the positioning holes (126) on the two sides of the supporting block (125) of the lower plate (12). The upper extending rods (124) on the two sides of the top of the U shape grooves (123) is inserted into the positioning holes (116) on the two sides of the nut (115) of the upper plate (11). Thus, the upper plate (11) can be firmly connected to the lower plate (12). Next, the groove (131) on the lower surface of the flat plate (13) is engaged to the engaging plate (115) of the upper plate (11) and the pillar (132) on the center of the engaging groove (131) is inserted into the positioning hole (116) on the middle of the engaging plate (115). Therefore, the flat plate (13) and the upper plate (11) are combined securely. Consequently, the upper plates (11), lower plates (12) and flat plates (13) are combined as a lattice-like frame. Then the related components of the floor (2) are placed on the high frame for assembly. At first, a plurality of connecting elements (22) are engaged to the periphery on the bottom of the outmost plate (21), then it is adhered to the upper surface of the flat plates (13) of the high frame (1). The first plate (21) is incorporated with the plates on the periphery by connecting elements (22). The process is continuous and then a surface of a floor (2) is assembled. After the floor (2) has been assembled, the edge element (23) is assembled outside the outermost plate (21).

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

What is claimed is:

1. An assembly type wood floor comprising a high frame and a floor portion, characterized in that:

the high frame is a net-like lattice frame formed by a plurality of upper plates, a plurality of lower plates and a plurality of flat plates. The upper plates is a rectangular plate with a plurality of through holes and two sides of which are installed with a rod through groove and a convex rod, the lower section of the upper plate is installed with a plurality of ⊓ shape grooves with equal spacing, two sides at the lower end of the ⊓ shape a groove are formed with respective lower protruding rods, a plurality of engaging plates are formed on the upper surface of the upper plates at a position with respect to the ⊓ shape groove, three linearly arranged positioning holes are formed on the center of the engaging plate, the lower plate is a rectangular plate with a plurality of through holes and a lower plate can be connected to the upper plate by a cruciform connection way, two sides of the lower plates are installed with a rod through grooves and a convex rod, the upper section of the lower plate has a plurality of U shape grooves spaced with an equal space, an upper extending rods are formed on the two sides at the upper end of the U shape grooves, a plurality of supporting blocks are installed on the lower surface of the lower plates with respect to the U shape grooves, by the supporting block, each lower surface of the lower plates will not contact with the ground, three linearly arranged positioning holes are installed on the central portion of the supporting block, each of flat plates are a square shape having a plurality of through holes and may be positioned so as to be parallel to the ground, a plurality of concave engaging a groove are formed on the bottom thereof with respect to the gap of the engaging plates of the upper plate, each of the engaging groove is preset with a pillar on the center thereof, when the flat plate makes the upper plate downwards, the pillar will pass through the middle positioning hole of each engaging plate;

the floor portion is formed by a plurality of plates pieces, a plurality of connecting elements and a plurality of edge elements, the lower section of plate pieces being a wood plate is circularly installed with inclined surfaces and ⊏ shape grooves, on the lower surface of the plate near the periphery is installed with ⊓ shape grooves, the connecting element is an integral blocks having an approximate 凸 shape, which each having formed by a transversal plates, a meddle plate and two lateral plates and a hook shape, a triangular block is preset on the middle section of the middle plate, and the upper section of the middle plate has a tapered tip with respect to the inclined surface on the periphery of the plate, the edge element is formed by integrating a T shape hard plates and a soft plate, the T shape element is formed by a transversal section, a hook and a groove section, the angle formed by the transversal section and a groove section is less than 90 degrees.

* * * * *